US006028422A

United States Patent [19]

Preusse

[11] Patent Number: 6,028,422

[45] Date of Patent: Feb. 22, 2000

[54] CURRENT TRANSFORMER

[75] Inventor: Norbert Preusse, Alzenau, Germany

[73] Assignee: Vacuumschmelze GmbH, Hanau, Germany

[21] Appl. No.: 09/284,713

[22] PCT Filed: Feb. 17, 1998

[86] PCT No.: PCT/DE98/00466

§ 371 Date: Apr. 19, 1999

§ 102(e) Date: Apr. 19, 1999

[87] PCT Pub. No.: WO98/36432

PCT Pub. Date: Aug. 20, 1998

[30] Foreign Application Priority Data

Feb. 17, 1997 [DE] Germany ..... 197 06 127

[51] Int. Cl.[7] ..... H01F 38/28

[52] U.S. Cl. ..... 323/357; 323/358

[58] Field of Search ..... 323/352, 353, 323/355, 356, 357, 358; 336/144, 192, 220

[56] References Cited

U.S. PATENT DOCUMENTS

| | | | |
|---|---|---|---|
| 3,701,003 | 10/1972 | Anderson . | |
| 3,777,217 | 12/1973 | Groce et al. | 324/133 |
| 4,513,274 | 4/1985 | Halder . | |
| 4,591,962 | 5/1986 | Schwarz et al. | 363/15 |
| 4,721,863 | 1/1988 | Bercy . | |
| 4,876,624 | 10/1989 | Chow | 361/87 |

FOREIGN PATENT DOCUMENTS

| | | |
|---|---|---|
| 0 092 653 | 11/1983 | European Pat. Off. . |
| 0 165 640 | 12/1985 | European Pat. Off. . |
| 7021882 | 6/1970 | France . |
| 195 32 197 | 3/1997 | Germany . |

*Primary Examiner*—Matthew Nguyen
*Attorney, Agent, or Firm*—Hill & Simpson

[57] ABSTRACT

A current transformer for mains alternating current with dc components is formed of at least one transformer core with a primary winding and at least one secondary winding, of load resistor is connected in parallel to the secondary winding and terminates the secondary circuit in low-impedance fashion. A semiconductor component that opens during a suitable time span within every cycle and is in turn closed is provided in the secondary circuit. During this time span, the secondary circuit is in a no-load condition. As a result thereof, the build-up of the core magnetization generated by the dc components is collapsed, and thus the transformer core cannot be driven into saturation, so that an over-dimensioning of the transformer cores is unnecessary.

8 Claims, 6 Drawing Sheets

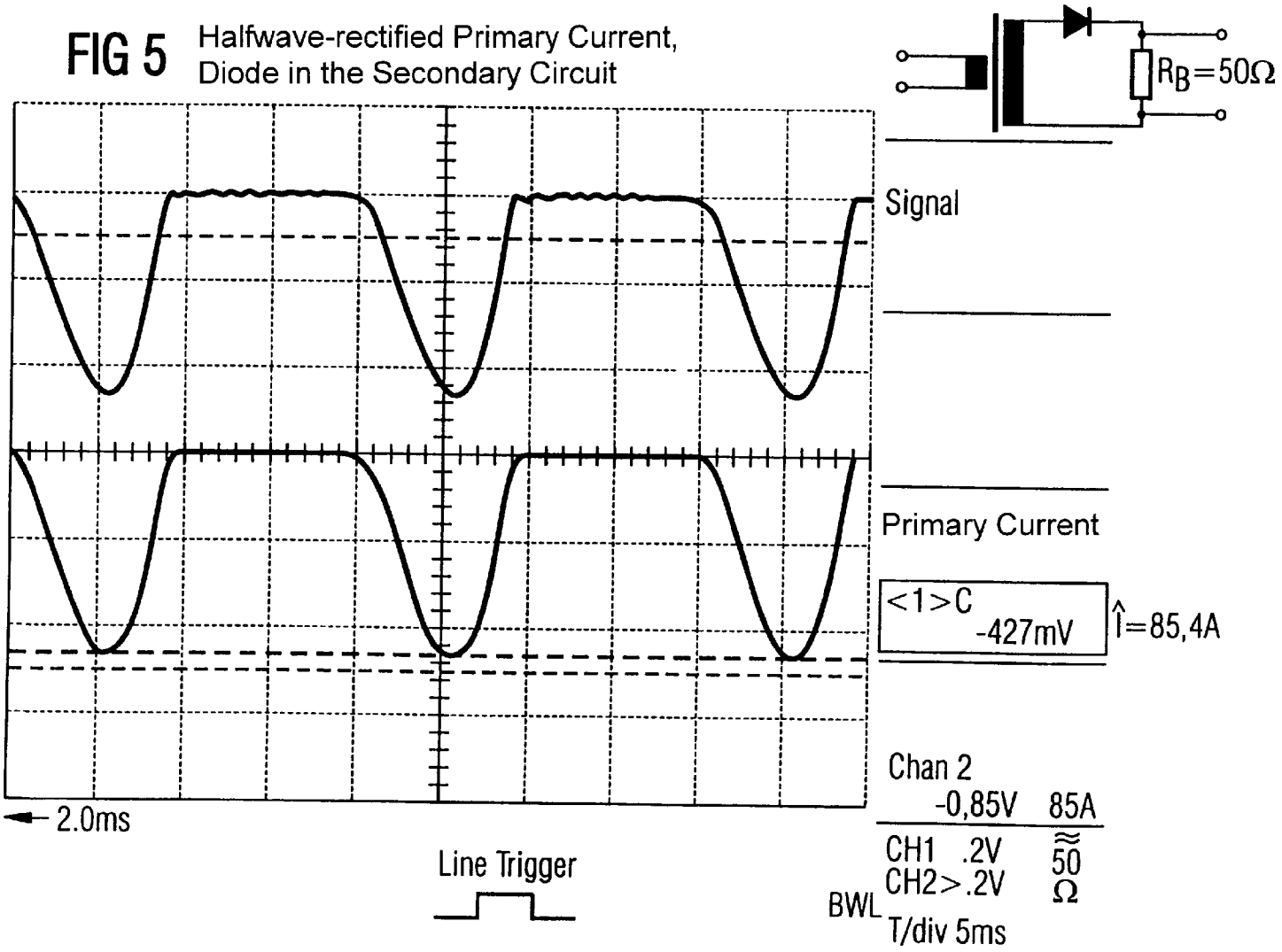
FIG 5 Halfwave-rectified Primary Current, Diode in the Secondary Circuit

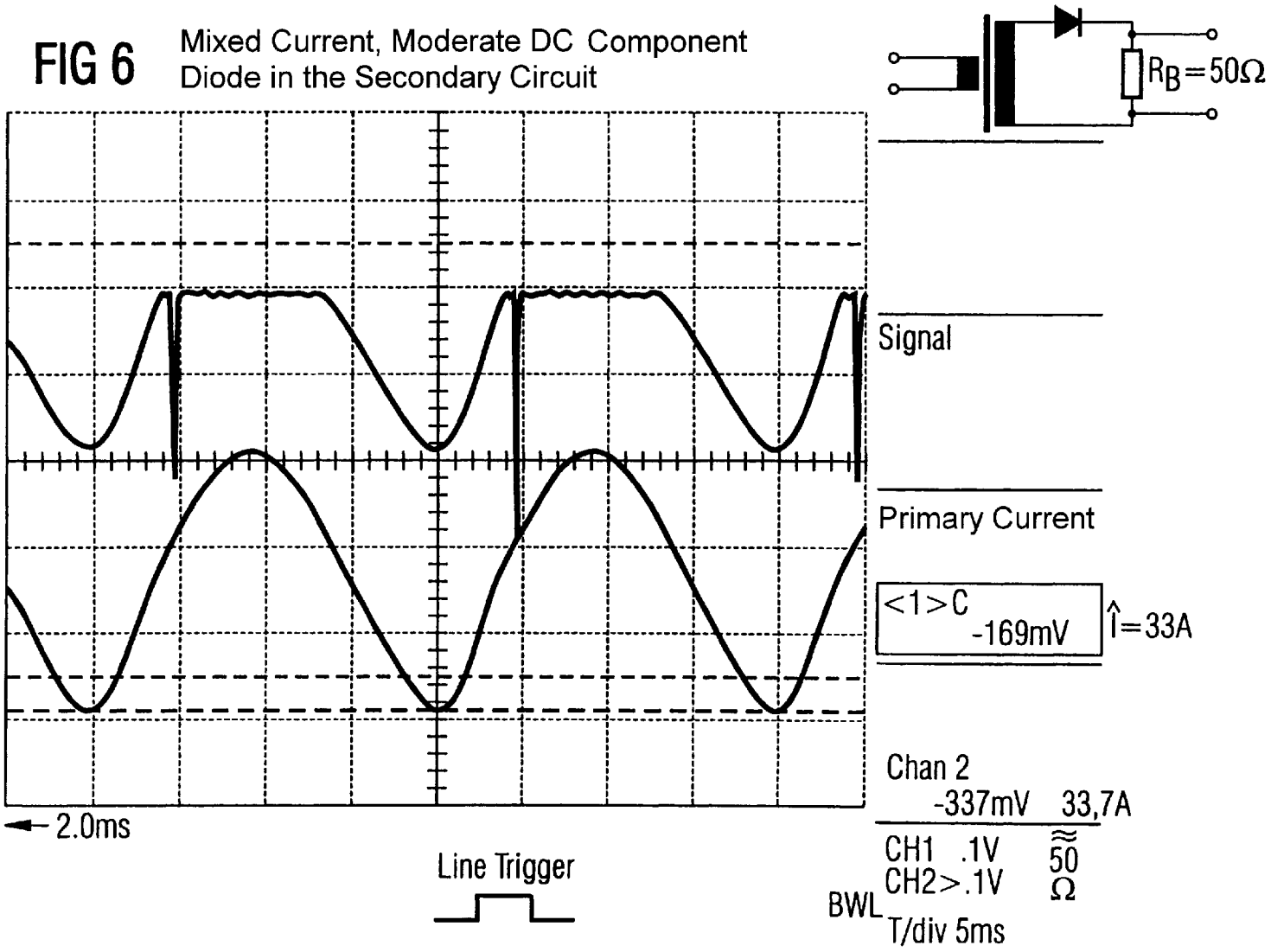
FIG 6 Mixed Current, Moderate DC Component Diode in the Secondary Circuit

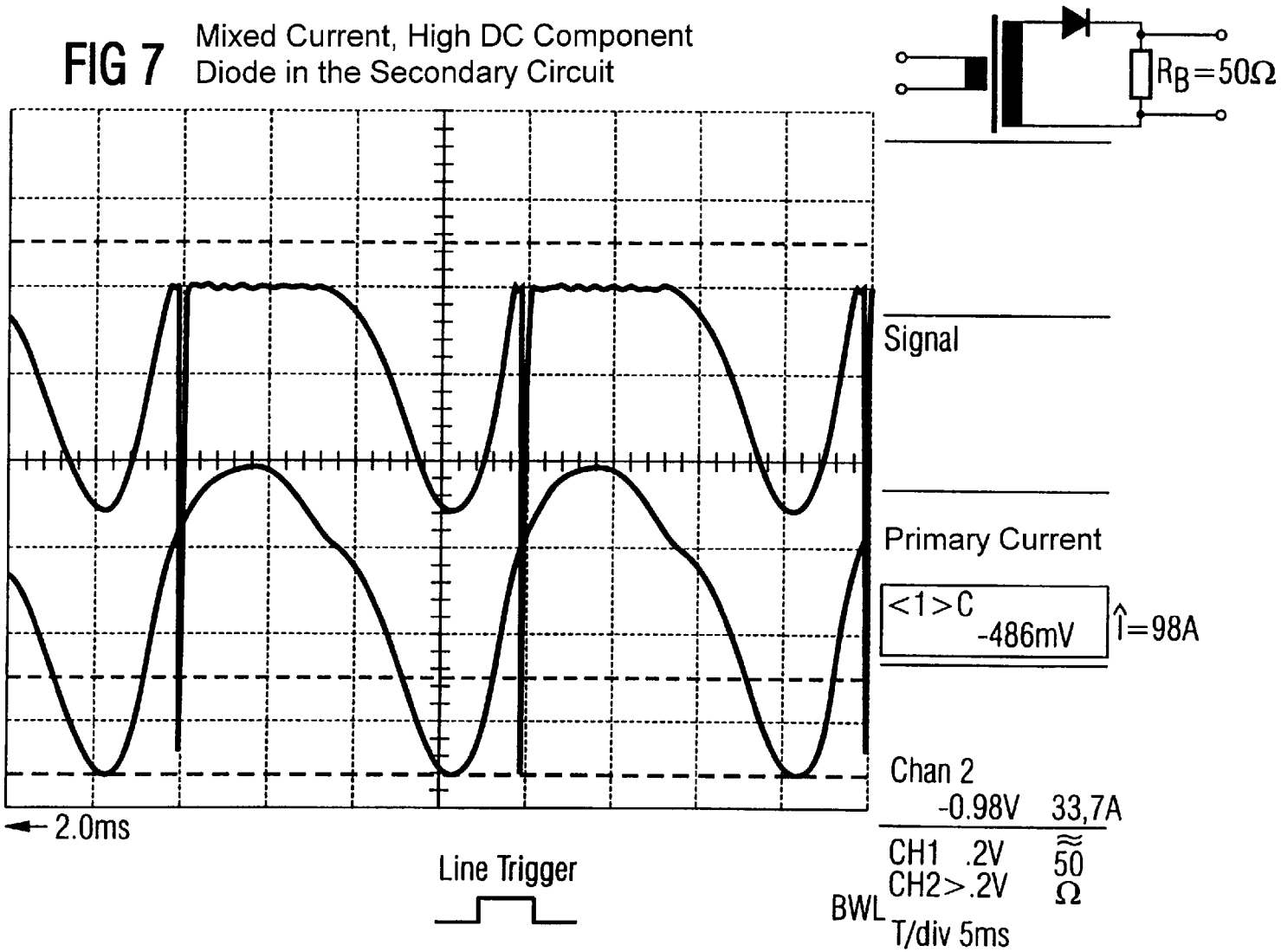
FIG 7 Mixed Current, High DC Component Diode in the Secondary Circuit

CURRENT TRANSFORMER

This application is a 371 of PCT/DE98/00466 filed Feb. 17, 1998.

BACKGROUND OF THE INVENTION

The invention is directed to a current transformer for alternating current, particularly mains alternating current, having dc parts, composed of at least one transformer core with a primary winding and at least one secondary winding to which a load resistor is connected in parallel and which terminates the secondary circuit in low-impedance fashion.

Such current transformers have been known for a long time. The current transformers transform a primary current onto a secondary current in relationship to the numbers of turns between primary and secondary winding, this secondary current then being acquired potential-free at the load resistor by a measuring instrument or a digital evaluation circuit. The range of current can, for example, be 100 A primary onto 50 mA secondary, and the secondary range of current can be of a standardized size. FIG. 1 shows the schematic circuit of a such a current transformer 1. The primary winding 2, which carries a current $i_{prim}$ to be measured, and a secondary winding 3, which carries the test current $i_{sec}$ are located on a transformer core 4 that can be constructed of tape cores similar to power transformers. The secondary current $i_{sec}$ is automatically established such that, ideally, the ampere turns at the primary and secondary side are of the same size and oppositely directed, for example $i_{prim}$=600 A and turns $n_{prim}$=2 at the primary side and $i_{sec}$=5 A and turns $n_{sec}$=240 at the secondary side. With a phase shift of 180° between primary current and secondary current. This derives from Lenz's Law, according to which the induction current is always certain to be established such that it attempts to prevent the driving cause.

The secondary winding is terminated low-impedance via a load resistor $R_B5$, i.e. the load resistor $R_B5$ is far, far smaller than the impedance of the secondary winding, i.e. $R_B<<\Omega L$. The magnetic fields that are generated by the two windings in the core—and this is the special feature of the current transformer—are of nearly the same size and directed opposite one another at any point in time. Only an extremely small magnetic flux is thus generated in the transformer core, this inducing a secondary current that just maintains the test current through the load resistor $R_B5$. Relative to the strength of the magnetic field emanating from the primary current, thus, the transformer core 4 is driven only very slightly.

Due to the eddy current losses and the remagnetization losses in the transformer core, losses in the windings and the load resistor, the ideal case is not completely achieved. What is understood by the quality factor of the current transformer is the ratio of the loss resistance $R_v$ and the impedance of the secondary coil $\Omega L$. The following relationships apply to the quality factor of the current transformer and should be optimally small:

$$\frac{R_{fll}}{\omega L} = \tan\delta, \tag{1}$$

$$\frac{R_{fll}}{\omega L} \approx \frac{\hat{B}}{\mu\mu_a \hat{H}}, \tag{2}$$

whereby tan δ denotes the phase shift between $i_{prim}$ and $i_{sec}$, H denotes amplitude of the magnetic field strength, B denotes amplitude of the magnetic field density B, $R_v$ denotes the loss resistance of the current transformer in which all loss mechanisms are combined and denotes the relationship between the magnetic drive of the transformer core to the drive field under the term at the right side of Equation (2).

Accordingly, the secondary current $i_{sec}$ exhibits a small phase shift relative to the driving current $i_{prim}$ and the amplitude of the magnetic flux density in the transformer core is significantly lower than given an exclusive drive by only the primary current. Typical values for the factor $R_v/\Omega L$ lie between 1/100 and 1/500.

The magnetic flux density B in the transformer core exhibits a phase shift of nearly −90° relative to the drive to the magnetic field or, respectively, the primary current. It thus has maximum values respectively close to the zero-axis crossings of primary current and secondary current.

These maximum values dare not reach the saturation flux density $B_{sat}$ of the core material. The current range that can be covered by a current transformer is defined by Equation (2) and the material constant $B_{sat}$. The above explanations are illustrated by FIG. 2.

Accordingly, the current transformers of the type species initially cited only function given nearly purely symmetrical alternating current. A dc component that can occur due to rectifying component parts in the primary circuit places the transformer core into magnetic saturation very quickly. The current transformer is then no longer functional.

This shall be explained below with reference to an example:

When a diode is situated in the primary circuit, then a pure half-wave rectification occurs thereat. The dc component of this form of current amounts to $i==1/\pi\hat{i}$. A current transformer that is designed for an alternating current amplitude of 100 A, accordingly, can already no longer work cleanly given a half-wave current with an amplitude of 1 A.

However, it is precisely a high dc tolerance that is demanded of current transformers that are to be utilized in energy meters. This demand was hitherto been taken into account in that the transformer cores employed were very highly over-dimensioned and, over and above this, were also potentially connected to a primary shunt, which sees to it that only a part of the primary current is conducted through the transformer core.

SUMMARY OF THE INVENTION

It is therefore an object of the present invention to offer a current transformer of the type species initially cited that is dc tolerant and precisely functional without over-dimensioned transformer cores.

This object is inventively achieved by a current transformer of the type species initially cited wherein at least one semiconductor component that periodically places the secondary circuit into no-load for a time interval is provided between a terminal post of the secondary winding and the load resistor.

As a result of this technique measure, the secondary circuit is opened for a specific time span within every cycle, so that collapsing or dismantling of the core magnetization can occur within this time interval. The inner time constant of the transformer core is then the determining factor for the collapsing dismantling of the core magnetization. This inner time constant of the transformer core is mainly defined by eddy current effects in the transformer core and is very slight, particularly given tape cores that are composed of a soft magnetic, highly permeable, amorphous or nano-crystalline alloy with high saturation induction.

Given such cores, the core magnetization can in turn be collapsed during a very short time span, and the magnetization cycle can restart at the original initial value after the closing of the secondary circuit.

The opening of the secondary circuit for a short time span thus has the function of a magnetic "reset" for the core. When this "reset" is implemented at a suitable point during every cycle, then an asymmetry in the driving alternating current, i.e. the dc components, has no negative influence on the behavior of the current transformer.

In one embodiment of the present invention, the current transformer comprises two transformer cores, each respectively having a secondary circuit. The diodes, which are connected in anti-parallel fashion, are situated in these secondary circuits. As a result thereof, the positive half-wave train is acquired in the one secondary circuit and the negative half-wave train is acquired in the other secondary circuit.

In an alternative embodiment of the present invention, the current transformer comprises a single transformer core that is provided with two secondary circuits. Diodes that are connected in anti-parallel fashion and exhibit different decommutation behavior are again situated in these secondary circuits. The different decommutation behavior is thereby critical, i.e. that the diodes exhibit a different blocking and transmission behavior. As a result thereof, both secondary circuits are simultaneously in lo-load for a brief time interval, which in turn leads to the collapsing of the core magnetization.

In a development of the present invention, the current transformer comprises a transformer core that is provided with a secondary circuit, whereby two diodes connected in anti-parallel fashion that exhibit different decommutation behavior are provided in this one secondary circuit. This embodiment works like the last-cited embodiment but has the advantage that only one secondary circuit is required, i.e. a single secondary winding and a single load resistor.

In a development of the present invention, a semiconductor switch is provided as semiconductor component, the load path thereof being connected between the terminal post of the secondary winding and the load resistor, whereby the semiconductor switch is provided with a control circuit that drives the semiconductor switch such that the secondary circuit is periodically in a no-load condition for a short time interval. This solution, which is somewhat more involved in circuit-oriented terms than the initially cited solutions with the non-linear passive semiconductor components, i.e. the diodes, in turn has the advantage that the time intervals can be exactly set and can also be adapted to various demands, i.e. to different types of primary circuits. Various active semiconductor components are available as semiconductor switches, these respectively having the focus of the employment in different voltage, current and frequency ranges. MOSFETs that can be obtained for blocking voltages up to 1000 V are preferably utilized in the lowest power range. All active semiconductor components up to dc voltages that correspond to approximately half the blocking voltage are usually employed, i.e. up to dc voltages of 500 V in the case of MOSFETs. The current is limited to a maximum of approximately 30 A, given these components. Insofar as these limit values are adequate for the intended use, switching frequencies up to 100 kHz can be realized with MOSFETs, which is surely adequate for most of the present applications. However, it is also conceivable to employ bipolar transistors and thyristors, particularly IGBTs (Insulated Gate Bipolar Transistor), MCTs (MOS-Controlled Thyristors) as well as GTOs (Gate Turn Off Thyristors).

In a development of this embodiment, the semiconductor switch is driven such that the secondary circuit is periodically in no-load for a brief time interval close to the zero-axis crossings of the secondary current. A drive such that the secondary circuit is periodically opened shortly before the zero-axis crossing of the secondary current and is closed exactly at the zero-axis crossing of the secondary current is optimal.

Given small primary currents, i.e. given primary currents that do not saturate the transformer core, it is also conceivable to open the semiconductor switch during the entire current crossing and to tap the voltage at the open secondary coil and utilize it for the power calculation. As a result of this technique, a significantly higher precision is achieved in the range of small primary currents, given a power calculation occurring over some connected measuring instruments.

In order to achieve a very small structural volume, the transformer core or cores exhibit the shape of a toroidal tape core, so that the current transformer is typically designed as a plug-through transformer. Plug-through transformer means that the primary conductor whose current is to be acquired is simply conducted through the opening of the toroidal core. However, it is also conceivable that the primary conductor is looped through the toroidal core with a very few turns. In current transformers of the type initially cited, the secondary winding is typically composed of approximately 1000 to 5000 turns.

The invention is illustrated by way of example in the drawings and is described in detail below with reference to the drawings.

BRIEF DESCRIPTION OF THE DRAWINGS

FIGS. 4–7 shows the comparison of various primary currents relative to various secondary currents.

DESCRIPTION OF THE PREFERRED EMBODIMENTS

Figure 1:
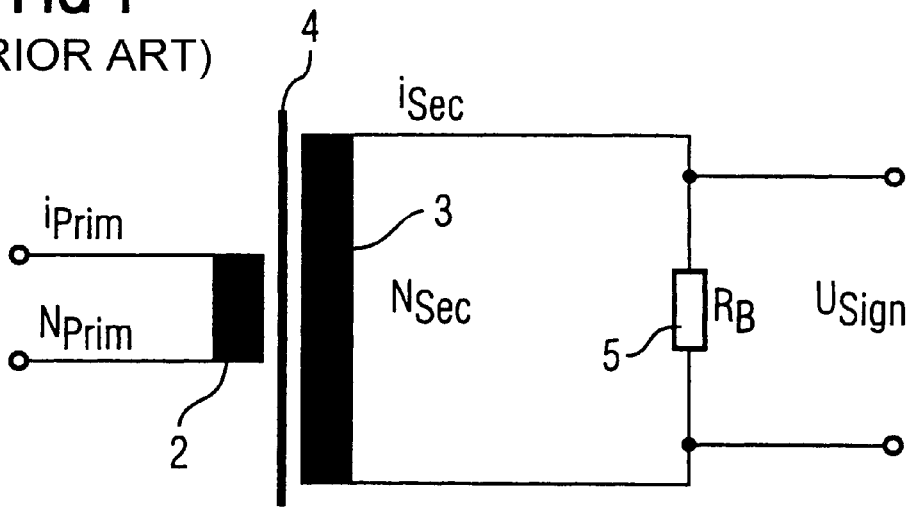
FIG 1 (PRIOR ART)
FIG. 1 is a schematic illustration of a current transformer.
Figure 3:
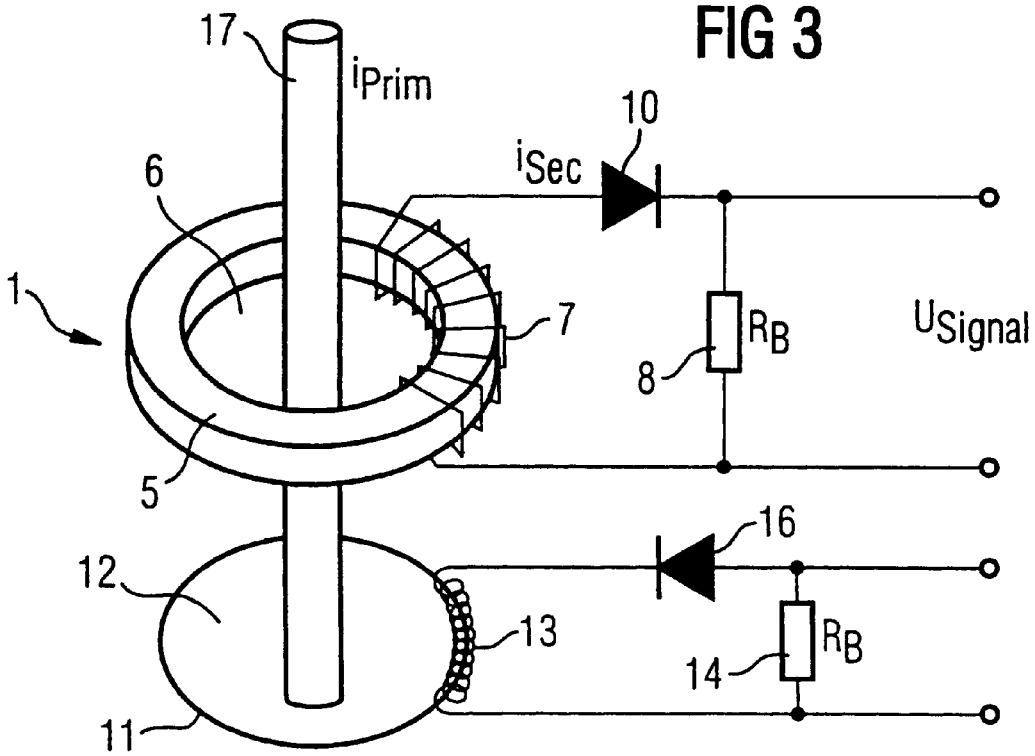
FIG. 3 is a perspective view of a current transformer according to the present invention in a schematic illustration.
Figure 2:
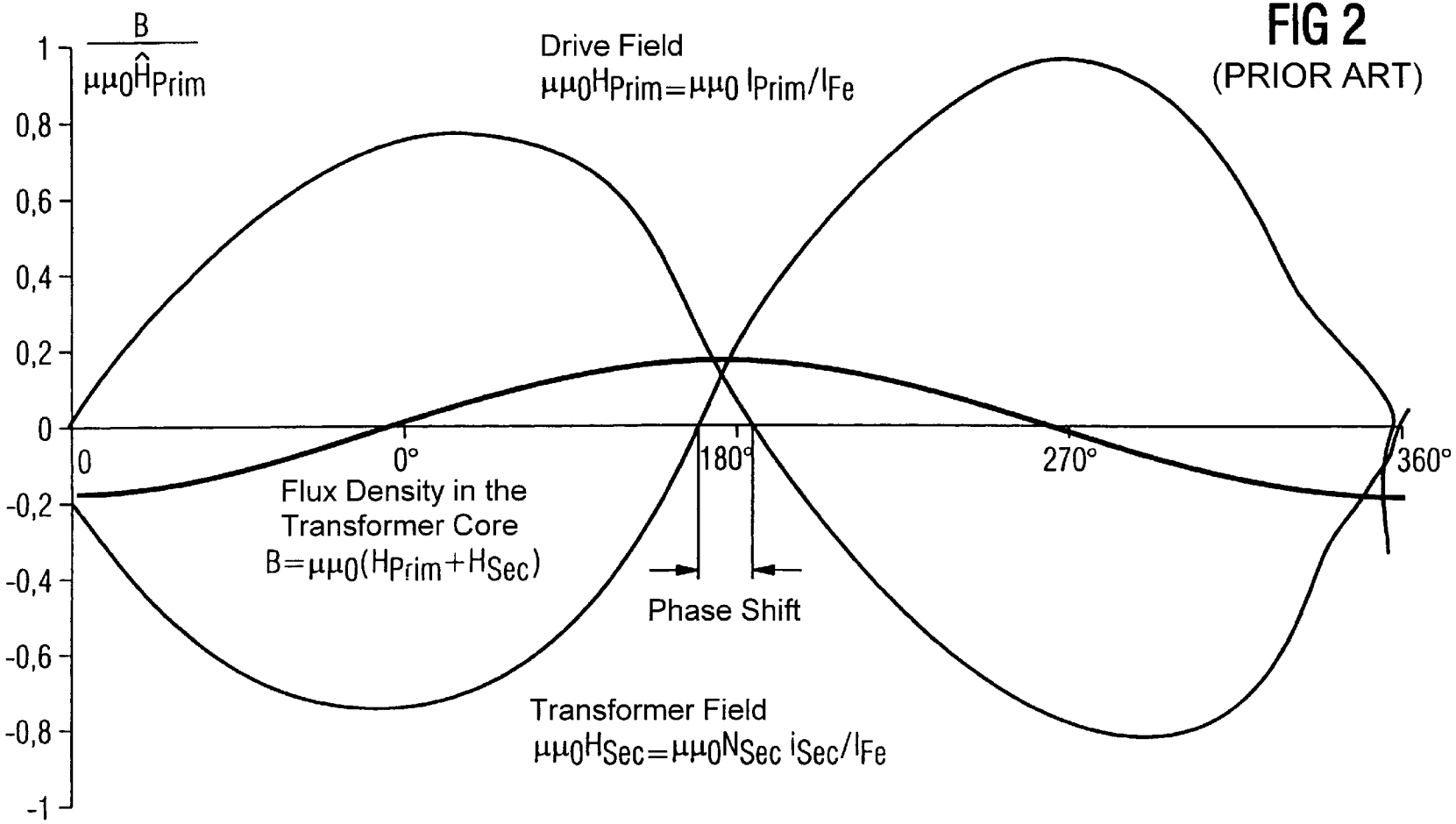
FIG 2 (PRIOR ART)
FIG. 2 is a diagram explaining magnetic flux density in the transformer core.

According to the drawing, the current transformer 1 of the present invention (See FIG. 3) is composed of a primary conductor 17 that is conducted through the opening 6 of a first toroidal tape core 5. This primary conductor 4 can be interpreted as a primary winding 2 having the turns $N_{prim}=1$. The primary conductor 17 is also conducted through the opening 12 of a second toroidal tape core 11. The first toroidal tape core 5 and the second toroidal tape core 11 comprise a secondary winding 7 or, a secondary winding 13. A first load resistor 8 is connected parallel to the first secondary winding 7, so that this first secondary circuit is terminated in low-impedance fashion. A load resistor 14 is likewise connected in parallel to the second secondary winding 13, so that this secondary circuit is also terminated in low-impedance fashion.

A diode 10 is situated in the first secondary circuit. The diode 10 opens the secondary circuit for a complete half-wave.

A diode 16 is likewise situated in the second secondary circuit, this being connected in the opposite direction, i.e. anti-parallel to the first diode 10. This diode 16 likewise opens the second secondary circuit for a complete half-wave. Since, however, the diode 16 is connected in the opposite direction from the diode 10, the one diode acquires the positive half-waves, whereas the other diode acquires the negative half-waves. As a result thereof, the two secondary circuits are phase-shifted by 180° in no-load, so that the two toroidal tape cores 5 and 11 can demagnetize in the respective no-load phases.

The inner time constant of the toroidal tape cores is thereby determinant for the collapsing of the core magnetization. This is mainly determined by eddy current effects in the toroidal tape cores. Here, the toroidal tape cores 5 and 11 are composed of thin tapes that are composed of a high-permeability, amorphous, soft-magnetic alloy, which assures that the eddy current effects are extremely slight. The core magnetization can thus be collapsed during the no-load phases, and the magnetization cycle can begin anew with the original initial value in the phases wherein the diodes 10 and 16 conduct the secondary current.

Figure 4:
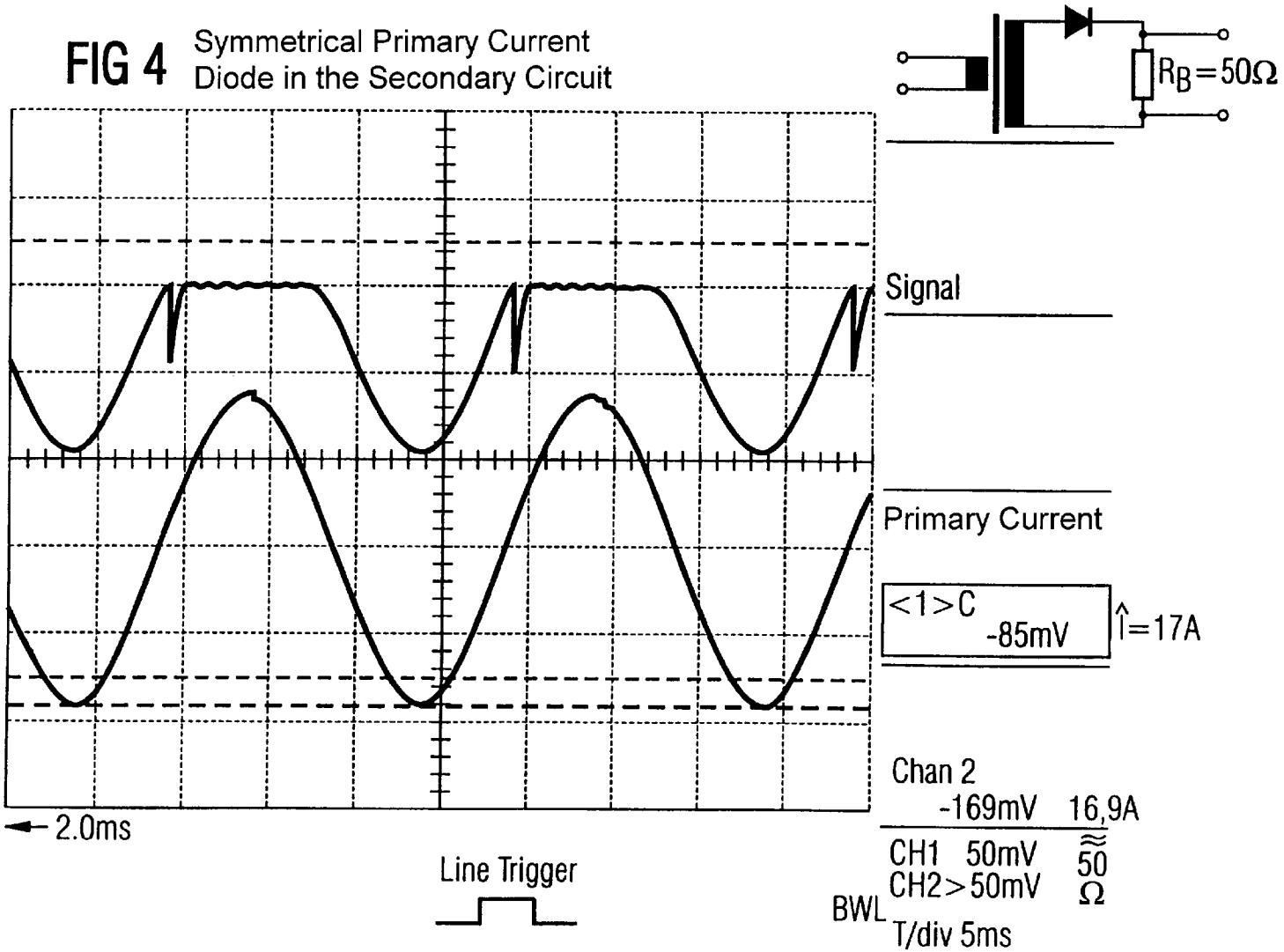

FIG. 4 shows a symmetrical primary current $i_{prim}$ and the current signal transformed in the first secondary circuit. As can be seen, only the negative half-waves are transformed due to the rectifying function of the diode. The signal in the second secondary circuit is completely analogous to the signal in the first secondary circuit; instead of the negative half-waves, the positive half-waves are merely transformed here.

FIG. 5 shows the current signal in the secondary circuit given a half-wave rectified primary current; FIG. 6 shows the current signal in the secondary circuit given a primary current that carries a moderate dc component; and FIG. 7 shows the current signal in the secondary circuit when the primary current carries a high dc component. Due to the rectifying function of the diode in the first secondary circuit and the oppositely rectifying function of the diode in the second secondary circuit, the asymmetries are completely transformed without the asymmetrical components thereby driving the core into saturation, since the toroidal tape cores have enough time in the no-load phases to in turn collapse their magnetization that has built up.

Although various minor changes and modifications might be proposed by those skilled in the art, it will be understood that my wish is to include within the claims of the patent warranted hereon all such changes and modifications as reasonably come within my contribution to the art.

I claim:

1. A current transformer for alternating current with dc components, comprising:

at least one transformer core with a primary winding and at least one secondary winding to which a load resistor is connected in parallel to terminate the secondary circuit in low-impedance fashion; and at least one semiconductor component for periodically placing the secondary circuit into no-load for a brief time interval, said semiconductor component being positioned between a terminal post of the secondary winding and the load resistor.

2. The current transformer according to claim 1 wherein the current transformer comprises two transformer cores, each having a respective secondary circuit and the semiconductor components located in the secondary circuits are diodes that are connected in anti- parallel fashion.

3. The current transformer according to claim 1 wherein the current transformer comprises a transformer core with two secondary circuits and the semiconductor components located in the secondary circuits are diodes that are connected in anti-parallel fashion and exhibit different decommutation behavior.

4. The current transformer according to claim 1 wherein the current transformer comprises a transformer core with a secondary circuit and two diodes connected in anti-parallel fashion that exhibit different decommutation behavior and arranged in the secondary circuit.

5. The current transformer according to claim 1 wherein a semiconductor switch is provided as said semiconductor component, a load path thereof being connected between the terminal post of the secondary winding and the load resistor, and the semiconductor switch being provided with a control circuit that drives the semiconductor switch such that the secondary circuit is in no-load for a brief time interval.

6. The current transformer according to claim 5 wherein the semiconductor switch is driven such that the secondary circuit is periodically in no-load for a brief time interval close to a zero-axis crossing of the secondary current.

7. A current transformer for alternating current with dc components, comprising:

at least one transformer core with a primary winding and at least one secondary winding to which a load resistor is connected in parallel to terminate the secondary circuit in low-impedance fashion; and at least one semiconductor component for periodically placing the secondary circuit into no-load for a brief time interval, said semiconductor component being connected to the secondary winding and the load resistor.

8. A method for operating a current transformer for alternating current with DC components, comprising the steps of:

providing at least one transformer core with a primary winding and at least one secondary winding to which a load resistor is connected in parallel to terminate the secondary circuit in low-impedance fashion; and periodically placing the secondary circuit into no- load for a brief time interval with at least one semiconductor component connected to the secondary winding and the load resistor.

* * * * *